United States Patent [19]

Moertel

[11] 4,247,968

[45] Feb. 3, 1981

[54] FASTENER STRINGER WITH TUBULAR FILAMENT ELEMENT

[75] Inventor: George B. Moertel, Conneautville, Pa.

[73] Assignee: Textron, Inc., Providence, R.I.

[21] Appl. No.: 601,788

[22] Filed: Aug. 4, 1975

[51] Int. Cl.[2] ..... A44B 19/12

[52] U.S. Cl. ..... 24/205.13 C; 24/205.16 C

[58] Field of Search ..... 24/205.13 D, 205.13 C, 24/205.7 C

[56] References Cited

U.S. PATENT DOCUMENTS

| | | | |
|---|---|---|---|
| 3,069,723 | 12/1962 | Porepp | 24/205.13 D |
| 3,072,991 | 1/1963 | Alberts | 24/205.13 D |
| 3,255,504 | 6/1966 | Porepp | 24/205.13 C |
| 3,579,748 | 5/1971 | Chery | 24/205.13 C |

FOREIGN PATENT DOCUMENTS

| | | | |
|---|---|---|---|
| 706581 | 3/1965 | Canada | 24/205.13 C |
| 1071616 | 12/1959 | Fed. Rep. of Germany | 24/205.13 D |
| 1260218 | 2/1968 | Fed. Rep. of Germany | 24/205.13 C |
| 575938 | 7/1957 | Italy | 24/205.13 C |
| 898611 | 6/1962 | United Kingdom | 24/205.13 D |
| 1218901 | 1/1971 | United Kingdom | 24/205.13 D |

*Primary Examiner*—Bernard A. Gelak

[57] ABSTRACT

A slide fastener has coupling elements secured to adjacent edges of a pair of carrier tapes wherein each of the elements is formed from a tubular filament by plastic deformation of selected portions, thus defining head portions, leg portions and connecting portions wherein the tubular filament has a ratio of filament wall thickness divided by the average inside diameter in the range of about 0.65 to about 1.8.

14 Claims, 19 Drawing Figures

FIG. 1
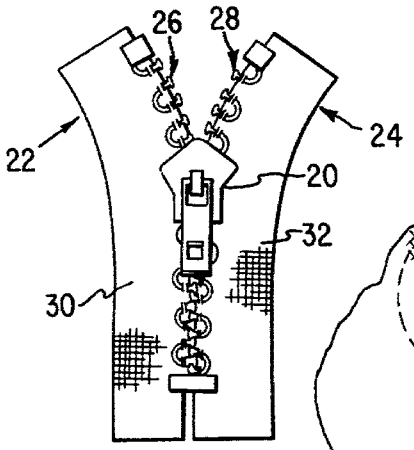
FIG. 2
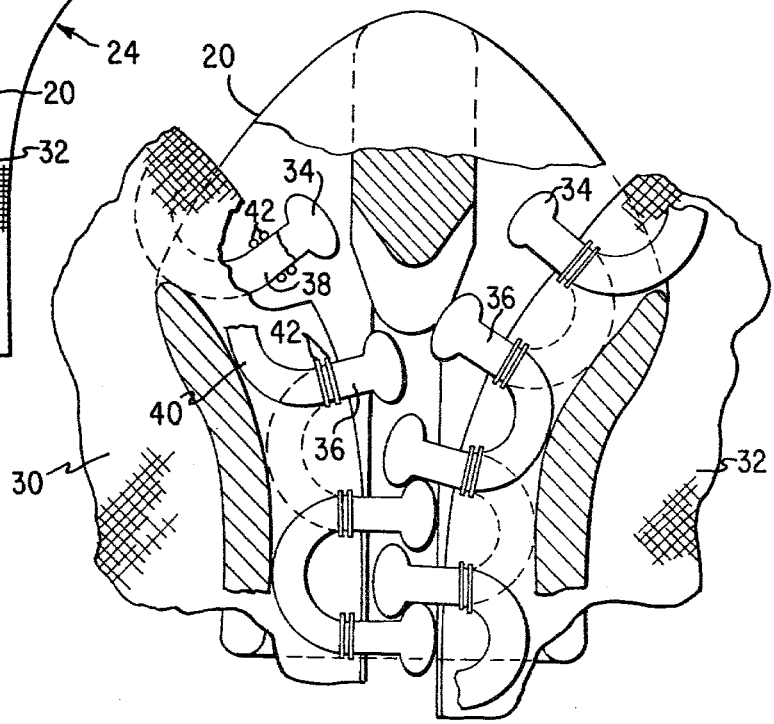
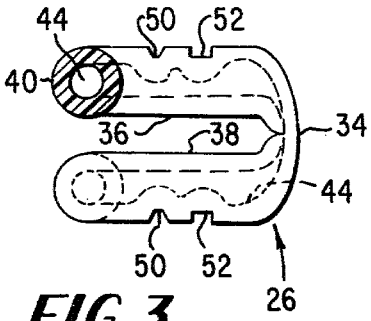
FIG. 3
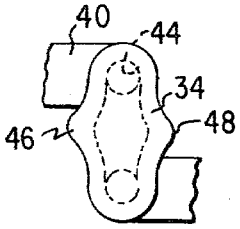
FIG. 4
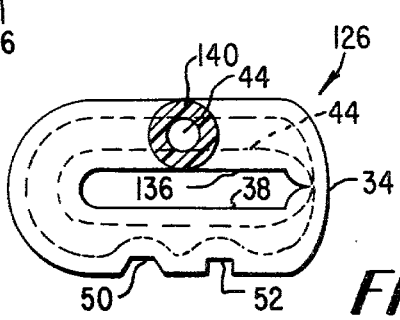
FIG. 10

FIG. 13
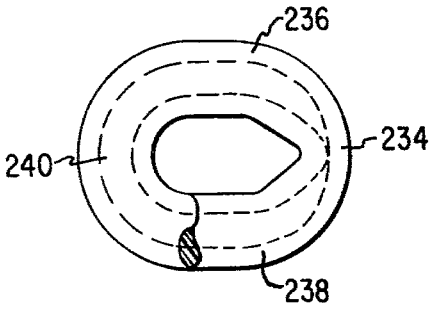
FIG. 14
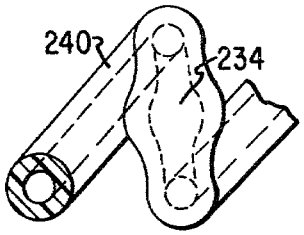
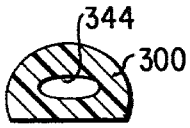
FIG. 15
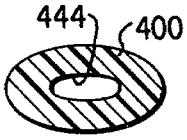
FIG. 16
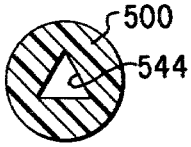
FIG. 17
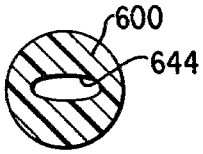
FIG. 18
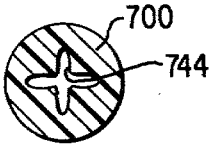
FIG. 19

FASTENER STRINGER WITH TUBULAR FILAMENT ELEMENT

BACKGROUND OF THE INVENTION

1. Field of the Invention

This invention relates to slide fasteners and in particular to slide fasteners having interlocked elements formed from filaments.

2. Description of the Prior Art

The prior art, as exemplified in U.S. Pat. No. 3,027,618 and No. 3,692,068 and Great Britain Pat. No. 981,511, contains slide fasteners having coupling elements formed from continuous filamentary material wherein portions of successive longitudinal sections of the filamentary material have been plastically deformed in cross section to form head portions, leg portions and connector portions joining the sections. The above U.S. Pat. No. 3,692,068 particularly discloses a method of and a loom for producing a tape having a list which may be hollow or in the form of a tube.

The plastically deformed portions in prior art filamentary coupling elements are not only deformed cross-sectionally but are also extended longitudinally due to the deformation; such longitudinal extension varies due to varying thicknesses of the filament to produce undesirable variation in the operational characteristics of the slide fasteners.

U.S. Pat. No. 3,018,610 discloses a filamentary material formed by combining a plurality of strands into a multistrand cord.

SUMMARY OF THE INVENTION

The present invention is summarized in a stringer for a slide fastener including a tape-like supporting portion; a coupling element secured to an edge of the supporting portion; the coupling element including a plurality of successive sections each of which have a head portion, a pair of leg portions extending from opposite sides of the head portion, and a connecting portion interconnecting leg portions of adjacent sections; and the coupling element further being formed from a continuous tubular deformable filament having a hollow core substantially throughout its length wherein the ratio of the average filament wall thickness divided by the average inside diameter is in the range of about 0.65 to about 1.8.

An object of the present invention is to produce a stringer with a filamentary coupling element having greatly improved operating characteristics.

Another object of the invention is to construct a stringer for a slide fastener having improved economy, formability, flexibility and ease of operation without substantially deteriorating the strength of the stringer to cross-wise forces and to resistance against damage during handling and attaching.

This invention has still another object to create a slide fastener which can be plastically deformed in cross section by greater amounts and more locations than has heretofore been possible.

An advantage of the invention is that the employment in slide fasteners of coupling elements formed from tubular filaments having selected cross-sectional sizes and shapes of hollow cores allows a much wider range of flexibility and fastener performance than has previously been possible.

One feature of the present invention is that the leg portions of a filamentary element of a slide fastener can be deformed cross-sectionally without producing elongation which would render the leg portions with undesirable variation in length and strength.

Other objects, advantages and features of the present invention will become apparent from the following description taken in conjunction with the accompanying drawings.

BRIEF DESCRIPTION OF THE DRAWINGS

FIG. 1 is a plan view of a slide fastener in accordance with the present invention.

FIG. 2 is a detail view, partially in cross section of a portion of the slide fastener of FIG. 1.

FIG. 3 is an end view of a section of one coupling element of the slide fastener in FIG. 1.

FIG. 4 is a side view of the coupling element section of FIG. 3.

FIG. 10 is an end view of a section of a modified coupling element suitable for use in a modified slide fastener.

FIG. 13 is an end view of a section of one coupling element of the slide fastener in FIG. 11.

FIG. 14 is a side view of the coupling element section of FIG. 13.

FIG. 15 is a transverse cross-sectional view of a second variation of the filament used to form coupling elements.

FIG. 16 is a transverse cross-sectional view of a third variation of the filament for forming the coupling elements.

FIG. 17 is a transverse cross-sectional view of a fourth variation of the filament for the coupling elements.

FIG. 18 is a transverse cross-sectional view of a fifth variation of the filament used in forming the slide fastener.

FIG. 19 is a transverse cross-sectional view of a sixth variation of the filament in the slide fastener.

DESCRIPTION OF THE PREFERRED EMBODIMENTS

Figure 5:
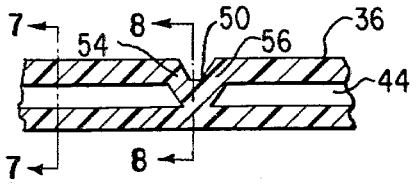
FIG. 5 is a detailed longitudinal cross-sectional view of one portion of a leg of the coupling element section of FIG. 3.

As illustrated in FIG. 1, the present invention is embodied in a slide fastener including a slider and pull assembly 20 which is slidable longitudinally along a slide fastener chain comprising a pair of stringers indicated generally at 22 and 24. The stringers 22 and 24 have respective coupling elements, indicated generally at 26 and 28, secured to adjacent edges of respective supporting members such as planarly disposed carrier tapes 30 and 32. The coupling elements 26 and 28, as shown in FIG. 2, are of the Ruhrman or meander ladder type in that each coupling element 26 and 28 is formed from a continuous filament which has successive coupling sections or convolutions each forming a head portion 34, a pair of leg portions 36 and 38 extending from opposite sides of the head portion 34 and a connector portion 40 interconnecting leg portions of adjacent sections wherein the leg portions 36 and 38 extend over the opposite sides of the tapes 30 and 32 and are secured thereto by threads 42 or other means in a conventional manner.

Figure 7:
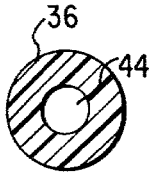
FIG. 7 is a transverse cross-sectional view taken along line 7—7 of the leg portion of FIG. 5.

The filaments forming the coupling elements 26 and 28 of the slide fastener are tubular filaments, as shown in FIGS. 3, 4 and 7, which have a wall defining a hollow core 44 substantially throughout the entire length of the filaments. The tubular filaments are made from a material, such as nylon, polyester, or the like, which is plastically deformable. The tubular filaments are selected to have a ratio of average filament wall thickness divided by average filament inside diameter within the range of about 0.65 to about 1.8. Preferably, the ratio is selected to be about 0.9.

Each of the sections of the tubular filaments is selectively deformed at preselected locations along its length to produce the head portions 34 which are transverse to the tapes 30 and 32 and which are enlarged relative to the adjoining leg portions 36 and 38 in dimensions parallel to the tapes 30 and 32. The head portion 34 is formed by flattening the tubular filament to produce protuberances 46 and 48 extending in opposite directions from the head portion 34 parallel to the edges of the tapes 30 and 32. A substantial portion of the deformation of the filament to form the head portion 34 results only in the collapse of the wall of the tubular filament into the hollow core 44. The deformation to form the head portion 34 may also include some plastic flow of the wall of the tubular filamentary material in order to produce the desired shape and size of the head portion 34.

Figure 6:
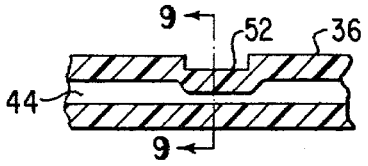
FIG. 6 is a detailed longitudinal cross-sectional view of another portion of the leg of the coupling element section in FIG. 3.
Figure 8:
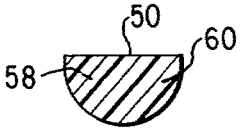
FIG. 8 is a transverse cross-sectional view taken along line 8—8 of the leg portion of FIG. 5.
Figure 9:
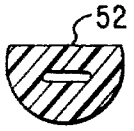
FIG. 9 is a transverse cross-sectional view taken along line 9—9 of the leg portion of FIG. 6.

As particularly shown in FIGS. 3, 5, 6, 8, and 9, the leg portions 36 and 38 have notches 50 and 52 formed in outward facing outer surface portions only on one side of the filament for receiving and retaining tape portions or the threads 42 to retain the coupling elements 26 and 28 relative to the edge of the tapes 30 and 32. The notch 50 is shown as being V-shaped while the notch 52 is generally rectangular. As shown in FIGS. 5 and 8, the notch 50 may be formed by complete collapse of a portion of the wall of the leg portion 36 into the hollow core 44 to completely join or seal the inner surfaces of the leg portion 36 at the notch 50 together. In FIGS. 6 and 9, the notch 52 is illustrated as being only a partial collapse of a portion of the wall of the leg portion 36 into the hollow core 44. The collapse of the wall into hollow core 44 is such as to produce substantially cancelling tension and compression forces longitudinally in the filament. For example, as shown in FIG. 5, the formation of the notch 50 produces stretching or elongation at points 54 and 56 while in FIG. 8 at points 58 and 60, compression and plastic flow of the material in the tubular wall occurs during the formation of the notch 50; the tension forces at points 54 and 56 substantially offsetting the compression forces at points 58 and 60 to prevent elongation of the leg portions.

In slide fasteners having tubular filaments with a ratio of average wall thickness divided by average inside diameter in the range of about 0.65 to about 1.8, there is a substantial increase in flexibility and ease of operation without gravely deteriorating the strength of the filament to withstand crosswise forces in use and to resist handling and attaching forces during manufacture. Additionally, the coupling elements are formed with substantially less material, i.e., the void 44 reduces the amount of material required to produce a selected diameter of filament and thus produces a less costly slide fastener. Further, the coupling elements are more easily formed since at least a substantial portion of the deformation of the filament to form the head portion 34 and the notches 50 and 52 in the leg portions 36 and 38 results from collapse of the wall of the tubular material rather than from plastic flow of the material. For smaller ratios down to about 0.65 the factors of economy, formability, flexibility and ease of operation are generally greater than for larger ratios while for larger ratios up to about 1.8 the strength of the coupling elements to withstand crosswise tension, handling and attaching forces are generally greater. The optimum ratio of approximately 0.9 generally results in balanced economy, productibility and performance; the optimum ratio being dependent upon the material used, the size of the filament, and the requirement of the use of the slide fastener.

By deforming the tubular filament material to form enlarged portions, notches and the like substantially entirely by collapse of a portion of the wall only on one side of the tubular filament into the hollow core, the offsetting tension and compression forces substantially prevent elongation of the filament which varies with filament thickness and the like; thus there is made possible greatly improved uniformity in slide fasteners which have improved operating characteristics due to the more precise control of the length of the deformed portions of the coupling element. Even where a significant amount of plastic flow in the walls of the tubular filament is necessary, such as in the head portion 34, the collapse of the wall into the hollow core substantially reduces the amount of plastic flow and thus reduces the amount of elongation resulting from such plastic flow.

A modified coupling element of the round coil ladder type, indicated generally at 126 in FIG. 10, for a slide fastener is formed from the tubular filamentary material used to form the slide fastener of FIGS. 1–9. Numbers used to identify parts of the slide fastener of FIGS. 1–9 are used to identify substantially similar parts of the slide fastener coupling element of FIG. 10. Connecting portions 140 of the round coil ladder type slide fastener form a coil or helix with head portions 34 and leg portions 38 and 136. Only the leg portion 38 has notches 50 and 52 formed therein to receive threads securing the coupling element 126 to only one side of a carrier tape.

Figure 11:
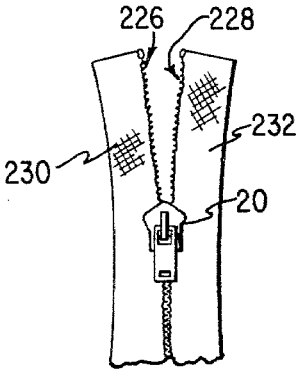
FIG. 11 is a plan view of another modified slide fastener.
Figure 12:
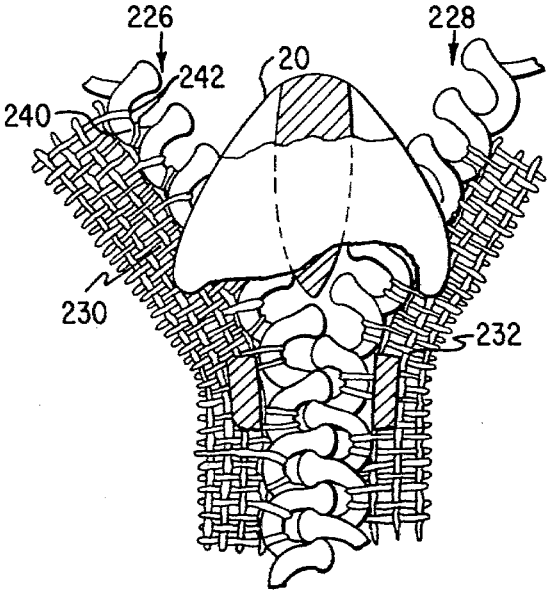
FIG. 12 is a detail view, partially in cross section, of a portion of the slide fastener of FIG. 11.

A further modified slide fastener, illustrated in FIG. 11, has a slider and pull assembly 20 which is slidable longitudinally along a pair of coupling elements indicated generally at 226 and 228 secured to adjacent edges of respectively planarly disposed tapes 230 and 232. As shown in FIG. 12, the coupling elements 226 and 228 are of the coil or spiral type in that each successive section of the coupling elements 226 and 228 forms a coil or convolution which is secured by threads, such as weft threads 242 of the tapes 230 and 232, to the adjacent edges of the tapes 230 and 232. As shown in FIGS. 13 and 14, each section or convolution is formed from tubular filament to produce a head portion 234, a pair of leg portions 236 and 238 extending from opposite sides of the head portion 234, and a connector portion 240 for interconnecting leg portions of adjoining sections or convolutions. The head portions 234 are formed by flattening the tubular filamentary material or collapse of the tubular wall into the hollow core such that tension forces offset compression forces during formation to prevent elongation of the filamentary material.

Second, third, fourth, fifth and sixth variations of filamentary tubular materials, illustrated in respective FIGS. 15, 16, 17, 18 and 19, can be utilized to form still further modified slide fasteners. The tubular filament employed in the embodiments of FIGS. 1–14 is generally circular in external cross section and has a hollow core of circular cross section. The tubular filament 300 of FIG. 15 has a D-shaped external cross section with a hollow core 344 of elliptical cross section; such D-shaped filaments can be utilized to form coil type interlocking elements wherein the head portions are formed solely by twisting or deforming the filamentary material in the leg portions such that the dimensions, parallel to the carrier tapes, of the head portion are enlarged relative to the dimension of adjoining leg portions parallel to the carrier tapes. The tubular filamentary material 400 in FIG. 16 has an elliptical external cross section and has a hollow core 444 of elliptical cross section. The external cross section of the filaments 500, 600 and 700 in FIGS. 17, 18 and 19, respectively, are circular while the cores 544, 644 and 744 of the respective filaments 500, 600 and 700 and are triangular, elliptical, and star-shaped, respectively. Various cross sectional configurations of tubular filamentary materials may be utilized to produce a slide fastener having selected and different performance characteristics.

Inasmuch as the presently described embodiments are subject to many modifications, variations, and changes in detail, it is intended that all matter contained in the foregoing description or shown in the accompanying drawings shall be interpreted as illustrative and not in a limiting sense.

What is claimed is:

1. A stringer for a slide fastener comprising a tape-like supporting portion;

a coupling element formed from a continuous tubular deformable filament secured to an edge of the supporting portion;

said coupling element including a plurality of successive deformed convolutions of the continuous tubular deformable filament;

each of said convolutions having a head portion, a pair of leg portions extending from opposite sides of the head portion, and a connecting portion interconnecting leg portions of adjacent convolutions;

said continuous tubular deformable filament having a hollow core substantially throughout its length wherein the ratio of the average filament wall thickness divided by the average inside diameter is in the range of about 0.65 to about 1.8, at least one of said head portion and said pair of leg portions of each convolution having a cross sectionally deformed portion whereat the wall of the tubular filament is collapsed into the hollow core such as to produce substantially cancelling tension and compression forces longitudinally in the filament to prevent any substantial elongation of the filament, one of said pair of leg portions of each convolution extending over a side of the tape-like supporting portion and having a notch formed therein facing away from the tape-like supporting portion, said stringer including a thread extending around the one leg portion of each convolution and laying in the notch of each convolution to secure the coupling element to the tape-like supporting portion, and said notch of each convolution being formed by collapse of a portion of the wall of the tubular filament into the hollow core of the filament.

2. A stringer for a slide fastener comprising a tape-like supporting portion;

a coupling element disposed along one edge of the tape-like supporting portion and formed from a continuous tubular deformable filament having a hollow core substantially throughout its length;

said coupling element including a plurality of successive deformed convolutions of the tubular filament;

each of said convolutions having a head portion, a pair of leg portions extending from opposite sides of the head portion, and a connecting portion interconnecting leg portions of adjacent convolutions;

at least one of said head portion and said pair of leg portions of each convolution having a cross-sectionally deformed portion whereat the wall on only one side of the tubular filament is collapsed into the hollow core; and said wall of the tubular filament being collapsed such as to produce substantially cancelling tension and compression forces longitudinally in the filament to prevent any substantial elongation of the filament.

3. A stringer for a slide fastener as claimed in claim 2 wherein the tubular filament has a ratio of average filament wall thickness divided by average inside diameter of approximately 0.9.

4. A stringer for a slide fastener as claimed in claim 2 wherein the tubular filament has a ratio of average filament wall thickness divided by average inside diameter in the range of about 0.65 to about 1.8.

5. A stringer for a slide fastener as claimed in claim 2 wherein one of said pair of leg portions of each convolution extends over a side of the tape-like supporting portion and has a notch formed therein facing away from the tape-like supporting portion, said stringer includes a thread extending around the one leg portion of each convolution and laying in the notch thereof to secure the coupling element to the tape-like supporting portion, and said notch of each convolution is formed by collapse of a portion of the wall on only one side of the tubular filament into the hollow core of the filament.

6. A stringer for a slide fastener as claimed in claim 2 wherein the tubular filament forming the coupling element includes a cross section having a circular periphery.

7. A stringer for a slide fastener as claimed in claim 6 wherein the cross section of the tubular filament has a circular opening concentric with the circular periphery.

8. A stringer for a slide fastener as claimed in claim 6 wherein the tubular filament forming the coupling element has a hollow core which is triangular shaped in transverse section.

9. A stringer for a slide fastener as claimed in claim 6 wherein the tubular filament forming the coupling element has a hollow core which is elliptical in transverse section.

10. A stringer for a slide fastener as claimed in claim 6 wherein the tubular filament forming the coupling element has a hollow core which is star-shaped in transverse section.

11. A stringer for a slide fastener as claimed in claim 2 wherein the tubular filament forming the coupling element has a cross section with a D-shaped periphery.

12. A stringer for a stringer as claimed in claim 11 wherein the tubular filament forming the coupling element has a hollow core of elliptical cross section.

13. A stringer as claimed in claim 2 wherein the tubular filament forming the coupling element has a cross section with an elliptical shaped periphery.

14. A stringer for a slide fastener as claimed in claim 13 wherein the tubular filament has a concentric hollow core of elliptical cross section.

* * * * *